United States Patent [19]

Sato et al.

[11] Patent Number: 4,652,110

[45] Date of Patent: Mar. 24, 1987

[54] IMAGE RECORDING APPARATUS

[75] Inventors: Yasushi Sato, Kawasaki; Masahiro Goto, Tokyo, both of Japan

[73] Assignee: Canon Kabushiki Kaisha, Tokyo, Japan

[21] Appl. No.: 704,076

[22] Filed: Feb. 21, 1985

[30] Foreign Application Priority Data

| | | | |
|---|---|---|---|
| Feb. 29, 1984 | [JP] | Japan | 59-38342 |
| Feb. 29, 1984 | [JP] | Japan | 59-38343 |
| Feb. 29, 1984 | [JP] | Japan | 59-38344 |
| Feb. 29, 1984 | [JP] | Japan | 59-38345 |
| Feb. 29, 1984 | [JP] | Japan | 59-38347 |
| Feb. 29, 1984 | [JP] | Japan | 59-38349 |
| Feb. 29, 1984 | [JP] | Japan | 59-38351 |
| Feb. 29, 1984 | [JP] | Japan | 59-38352 |
| Feb. 29, 1984 | [JP] | Japan | 59-38353 |

[51] Int. Cl.[4] ..... G03G 15/20

[52] U.S. Cl. ..... 355/3 FU; 219/216; 162/271

[58] Field of Search ..... 355/3 FU, 3 SH, 30, 355/3 R; 219/216, 388, 271, 273, 401; 162/270, 271

[56] References Cited

U.S. PATENT DOCUMENTS

| | | | |
|---|---|---|---|
| 4,505,695 | 3/1985 | Billings | 162/271 X |
| 4,549,932 | 10/1985 | Goetz et al. | 162/271 X |

*Primary Examiner*—R. L. Moses

*Attorney, Agent, or Firm*—Fitzpatrick, Cella, Harper & Scinto

[57] ABSTRACT

An image forming or recording apparatus provided with an image fixing device of a heating type, which may cause curl of the recording material when the recording material is discharged from the fixing means. The causes of the curling are investigated, and a device is provided which can effectively correct or remove the curl of the recording material with a very simple structure. The device includes a passage for applying water vapor to the recording material, immediately after it is discharged from the fixing device. As a supply of the vapor, the moisture contained in the recording material is utilized.

31 Claims, 24 Drawing Figures

IMAGE RECORDING APPARATUS

BACKGROUND OF THE INVENTION

The present invention relates to an image recording apparatus such as a printer, copying apparatus and a composite image recording apparatus. More particularly, the present invention relates/to an image recording apparatus provided with toner image forming means for forming a toner image with a dry developer and provided with an image fixing means for fixing the toner image, the toner, that is, the developer including a thermoplastic resin, carbon pigment or dye or the like.

Conventionally, for the purpose of fixing the toner image, a heat fixing means is used, in which a large quantity of heat is applied to the toner and the sheet bearing the toner image. This heat vaporizes the moisture contained in the sheet. Since the heat quantity applied to the front side of the sheet is not equal to that applied to the backside thereof, the amounts of the evaporation are not equal. This results in the sheet curling. When a sufficient quantity of heat is applied to each side of the sheet, the rigidity of the sheet is decreased with the evaporation of the moisture contained in the sheet. Therefore, the configuration of the curling is determined by the conditions under which the sheet is placed immediately after the sheet is discharged from the heat fixing device.

The occurrence of curling is cumbersome, particularly when the image recording apparatus is equipped with a sorter for automatically sorting the discharged sheets or when the image recording apparatus is of a duplex type wherein images are recorded on both sides of a sheet. This is because there may be a trouble in the transportation of the sheet. In the duplex type image recording apparatus, addition to the unsatisfactory transportation of the sheet to an intermediate tray, a trouble can occur when the sheet is separated from a photosensitive member after an image is formed on the photosensitive member and then transferred to the second side of the sheet. The trouble in the separation may result in a disturbance to the image.

Laid-Open Japanese Patent Application No. 81270/1982 proposes, in order to solve the problem described above, that the sheet itself is improved from the standpoint of reducing the amount of curling. More particularly, the moisture content of a sheet is maintained 5.5–6.5% so as to maintain to a desired rigidity in the sheet. This, however, limits the sheets which are usable, and can not satisfactorily be used with plain paper. In addition, the sheets are vulnerable to changes in ambient conditions, for example, the sheets absorb moisture under relatively high humidity conditions, resulting in less rigidity. Furthermore, when the amount of evaporation increases, the amount of curling may be increased.

U.S. Pat. No. 4,375,327 proposes a heat fixing device including a heat fixing roller and a pressing roller, wherein a separation pawl is provided so as to contact the pressing roller, and the distance between the separation pawl and the nip between the fixing roller and the pressing roller is reduced.

Laid-Open Japanese Patent Application No. 113637/1976 proposes that the speed of sheet transportation be higher after the sheet is discharged from the nip in the fixing device than during its transportation in the fixing device.

However, those proposals are not able to deal with the curling of a particular portion of the sheet or the entirety thereof. Particularly in the case of the duplex image recording, the trailing end of the sheet in the first side printing becomes the leading edge in the second side printing, and therefore, it is necessary to regulate the curling in the neighborhood of the sheet trailing edge in the first side printing. The above two proposals are not satisfactory to meet this necessity. U.S. Pat. No. 4,375.327 mentioned above is effective to regulate a waveform curling, and the Japanese Laid-Open Patent Application can regulate curling only when the sheet is between the fixing roller and transporting means located downstream thereof. Thus, neither can deal with curling in the neighborhood of the leading or trailing edge of the sheet.

There are other proposals for the purpose of regulating or eliminating curling of the sheet at the discharge of the fixing roller, but they are not satisfactory in order to meet curling from the leading edge to trailing edge.

Laid-Open Japanese Patent Application No. 143339/1978, noting that the sheet curling is the most particular problem in the duplex printing, proposes that a toner image on the first side is temporarily fixed, and the toner images on the two sides are fixed to a sufficient extent when the second side toner image is fixed. During the fixing operation for the first side, that is, the temporary image fixing, the sheet does not receive a large quantity of heat so that the amount of curling is not large, but correspondingly, the image fixing is not sufficient. Those insufficiently fixed toner images may be scraped off by transporting rollers and so on during the sheet transportation for the second side image formation. As will be understood, the conditions for providing satisfactory fixing and the conditions for reduced curling, are contradictory to each other, and the conditions under which both are satisfactory are so limited that reducing amount of the curling by degrading slightly the fixing performance is practically very difficult.

The inventors found Laid-Open Japanese Patent Application No. 24862/1984, of which neither inventor was aware prior to the achievement of the present invention. The fixing device disclosed therein is provided with a water pan located above the fixing mechanism. The pan is heated by the heat emitted from the fixing mechanism after it is sufficiently heated. Thereafter, the water in the pan is heated thereby and is evaporated. In this system, a state is formed outside the copying mechanisms, wherein the water vapor is dispersed in the ambient atmosphere. Then, the sheet after being subjected to the image fixing operation is introduced in the ambience.

However, it requires a long time from the start of the water pan heating to the water therein becoming evaporated. The time is much longer than the time required from actuation of the main switch to the copyable state being reached. Therefore, the sheet curling could not be prevented during a significant time period from the time the copyable state is reached. Since the amount of the water contained in the water pan is necessarily limited, curl prevention is not performed after the water is consumed. It would be possible to replenish the water into the water pan, but this would require complicated mechanisms for the control because the temperature in and of the copying machine is increased by the continuous long operation. Further, the manner in which the curling which will be described hereinafter is prevented is not known.

SUMMARY OF THE INVENTION

Accordingly, it is a principal object of the present invention to provide an image recording apparatus wherein the curl correction or prevention for the recording material becomes possible substantially simultaneously with the time the recording apparatus becomes operable, and wherein the effective prevention can be maintained in a stabilized manner for a long period of time.

It is another object of the present invention to provide an image recording apparatus which does not require a maintenance, such as supplying water, and which is sure to correct the curling into a desired state.

It is a further object of the present invention to provide an image recording apparatus wherein the recording material is corrected into substantially trouble-free shape, substantially regardless of the change in the recording mode (duplex recording, superimposing recording or the like), the thickness of the recording material, the moisture content of the recording material, the size of the recording material or the state of deformation at each portions of the recording material.

It is a further object of the present invention to provide a recording apparatus wherein water vapor is efficiently utilized, and wherein the curling correction is effected to a necessary and sufficient extent.

These and other objects, features and advantages of the present invention will become more apparent upon a consideration of the following description of the preferred embodiments of the present invention taken in conjunction with the accompanying drawings.

FIGS. **20*a* and 20*b*** are cross-sectional views of the sheet having a shape which is not preferable.

DESCRIPTION OF THE PREFERRED EMBODIMENTS

Figure 1:
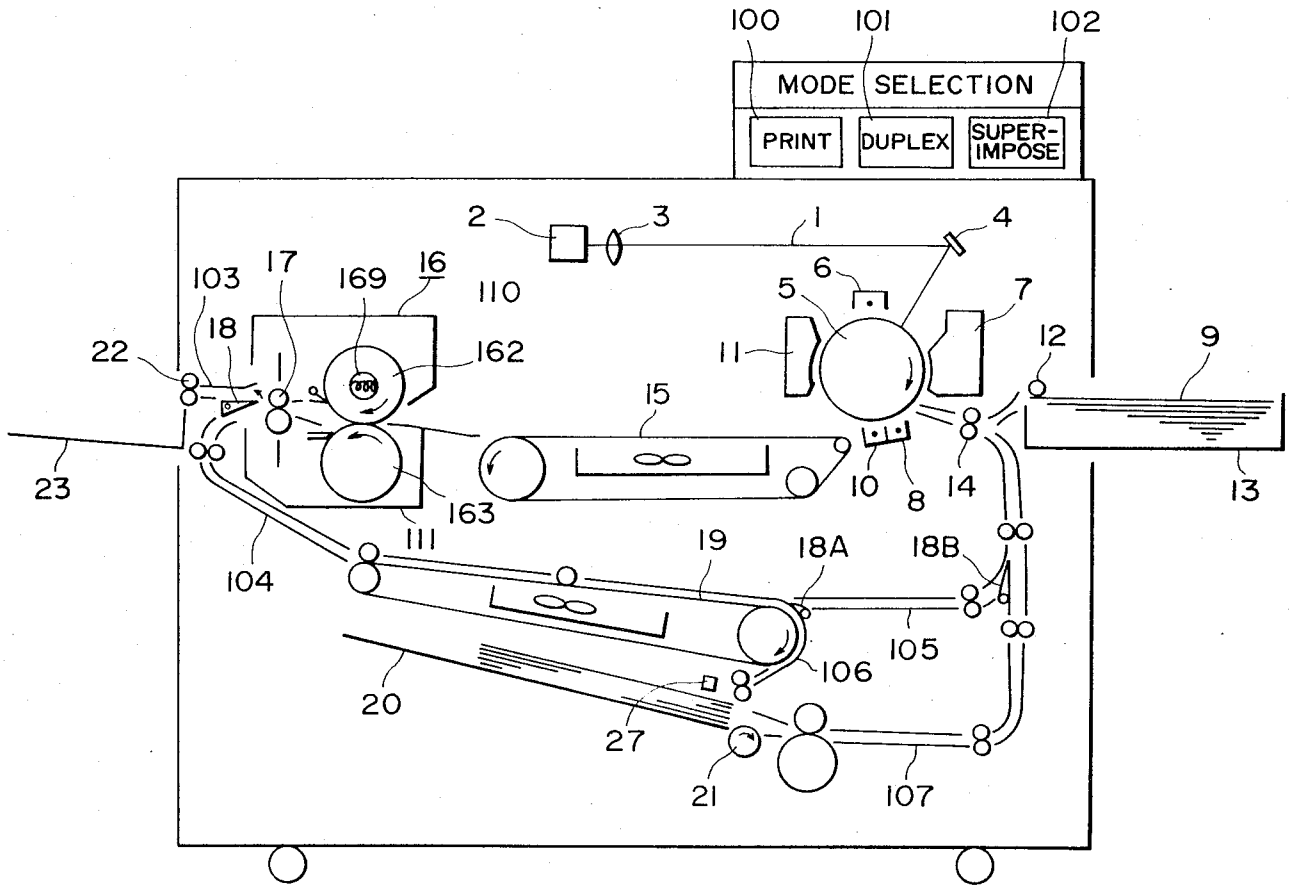
FIG. 1 is a somewhat schematic cross-sectional view of an image recording apparatus, which is a laser beam printer by way of example, according to an embodiment of the present invention.

Referring to FIG. 1, there is shown an image recording apparatus according to the first embodiment of the present invention, which apparatus is operable in a duplex mode wherein the image can be recorded on each side of the recording material and in a superimposing mode wherein plural image formations can be effected on one side of the recording material as well as in the usual printing mode.

In this apparatus, upon generation of a printing signal or actuation of a printing key 100, a laser beam 1 which is modulated in accordance with external signals or internally generated signals, is deflected by a scanner 2. The laser beam 1 passes through an imaging lens 3 and is then reflected by a mirror 4 to be directed to an image bearing member in the form of a photosensitive drum 5, on which the laser beam is imaged. Prior to this, the photosensitive drum 5 has been uniformly charged by a corona charger 6 to be sensitized. Therefore, an electrostatic latent image, that is, an electrostatic pattern, is formed on the photosensitive drum 5 in accordance with the projection of the laser beam 1 which is modulated in accordance with the information to be recorded. The electrostatic latent image is then developed into a toner image by a developing device 7.

On the other hand, the recording material in the form of a sheet 9 is fed out of a cassette 13 by a roll 12, and then further fed by a registration roller 14 at a timing in alignment with the image formed on the photosensitive drum 5. Thereafter, the recording material receives the toner image from the photosensitive drum 5 with the aid of a transfer corona discharger 8. Then, the recording material is separated from the photosensitive drum 5 with the aid of the separation corona charger 10 and then transported to a heat fixing device 16 by a transporting belt 15. The photosensitive member 5, after the recording sheet is separated therefrom, is cleaned by a cleaning device 11 so as to be prepared for the next image forming operation.

The sheet 9 which has been subjected to the image fixing operation and discharged from the heat fixing device 16 is received by a tray 23 when in the usual printing mode, that is, one-sided printing operation.

During this, the sheet 9 is corrected in its shape in the manner which will be described hereinafter.

When the duplex printing mode is selected by the actuation of the duplex key 101 or by another instruction signal, a passage selection pawl 18 provided between the discharging roll 22 and the discharging rollers 17 of the fixing device, is positioned as shown in FIG. 1 so as to allow the duplex mode operation. Also, the passage selecting pawls 18A and 18B take the positions shown in FIG. 1. Therefore, in this mode, the passage for the sheet 9 includes the passages 104, 106, 107, a transporting belt 19 and an intermediate tray 20. The sheet 9 is reversed by the passage 104 and by the passage 106, so that it is supported face up on the intermediate tray 20, that is, the side of the sheet having the image faces up.

Next, the sheet 9 is fed from the intermediate tray 20 by an intermediate feeding roller 21 and directed to the photosensitive member at a timing determined by the registration roller 14 so as to be synchronized with the image formed on the photosensitive member. The sheet 9 is transported face down toward the transfer corona charger 8, by which another toner image is transferred onto the second side of the sheet 9. Thereafter, the sheet is separated, transported and is subjected to the image fixing operation in the manner similar to the case of the one sided printing. Subsequently, the recording sheet 9 is discharged to the tray 23 by the discharging roller 22. At this time, the pawl 18 opens the passage 103 to allow the sheet 9 to go to the passage 103.

When the superposing printing is selected by the superimposing key 102 or by another instruction signal, the pawls 18A and 18B take the positions which are opposite to the duplex printing mode position so as to use the passage 105. Through this passage 105, the sheet 9, during the second image transfer operation, is transported with its recorded side facing the photosensitive drum 5, so as to receive the second image on the same side as the first image. The other operations are the same as in the duplex mode recording.

In the duplex and superimposing mode operations, the treatment to the sheet, which will be described hereinafter, is given to the sheet 9. In this embodiment, the photosensitive drum 5 is exposed to a modulated laser beam, but it may be exposed to the light reflected by an original to be reproduced.

Figure 4:
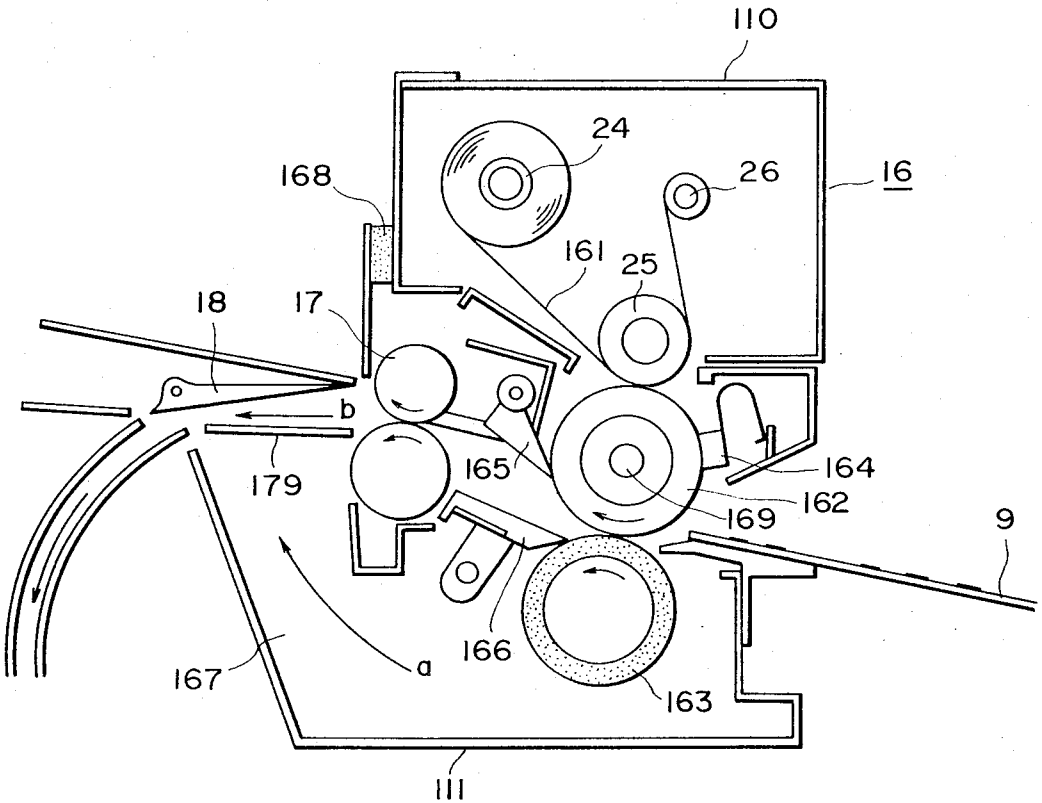
FIG. 4 is a cross-sectional view of the structure of and around the fixing device used in the apparatus according to the embodiment of the present invention.

FIG. 4 is a cross-sectional view of the heat fixing device usable with the recording apparatus according to the present invention. The heat fixing device 16 includes a fixing roller 162 and a pressing roller 163 press-contacted to the fixing roller 162. The fixing roller 162 includes a core metal member of stainless steel, aluminum, steel or the like, which is coated with a non-adhesive, heat-resistive and resilient layer, which may be, for example, a non-adhesive and heat-resistive resin such as ethylenetetrafluoride, high temperature or room temperature vulcanized silicon rubber (HTV-Si rubber, RTV-Si rubber) or FLC (trade name, available from Nitto Kogyo Kabushiki Kaisha, Japan) having a silicon rubber coated with fluorine Ratex (a mixture of fluorine-contained rubber and fluorine-contained polymers). The fixing roller 162 further includes therein a heating source such as a halogen heater 169. The pressing roller 163 includes a core metal member of stainless steel or steel or the like coated with HTV, LTV, FLC or the like, which are non-adhesive, heat resistive and resilient. In this embodiment, the heating source is provided only in the fixing roller, but not in the pressing roller 163. Therefore, the surface temperature is higher on the fixing roller surface than on the pressing roller surface. Since the pressing roller 163 has a higher resiliency than the fixing roller 162, the contact area therebetween has a curved shape contoured on the fixing roller surface. The discharging roller couple 17 is driven at a speed slightly higher than that of the fixing roller 162 and the pressing roller 163 by a driving mechanism (not shown) so as to pull the leading edge of the sheet 9, thus tensioning the sheet 9 between the roller couple 17 and the nip between the fixing roller 162 and the pressing roller 163.

The surface temperature of the fixing roller 162 is detected by a sensor in the form of a thermistor 164, for example. And, the surface temperature is maintained constant by a known control circuit (not shown). It is possible that the toner on the sheet 9 can off-set to the fixing roller 162. Such off-set toner is removed therefrom by a cleaning web 161 which contains silicone oil. Other means may be used in place of the oil application member and/or the cleaning member.

The cleaning web 161 is fed out of a supply reel 24 and press conacted to the fixing roller 162 by the urging roller 25, and then wound around a take-up reel 26. The fixing device 16 further includes a pawl 165 having an edge contacted to the surface of the fixing roller 162 by a spring force exerted by a spring (not shown) so as to prevent the sheet 9 from wrapping around the fixing roller 162. Similarly, a pawl 166 is contacted to the pressing roller 163 surface by an unshown spring so as to prevent the sheet 9 from wrapping around the pressing roller 163.

The means and members described above with respect to the fixing device are contained in a casing consisting of an upper casing 110 and a lower casing 111 which form openings for allowing the entering and the discharging of the sheet 9. The casing is substantially sealed in the other portions.

Designated by a reference numeral 167 is a water vapor passage for conveying water vapor emanated from the sheet 9 in the fixing device 16. The passage 167 extends from the bottom portion of the fixing device 16 to the neighborhood of the sheet discharging side of the image recording apparatus, preferably to such a position as is between the discharging rolls 22 and the discharging roller couple 17 and as is before the position where the sheet transporting passage is branched. The vapor passage 167 is an example of vapor applying means and is formed in this example by inclining the rear wall of the lower casing 111 toward rear side.

The sheet 9, which has received the toner image from the photosensitive drumm 5, is transported to the heat fixing device 16, where it is passed through the nip between the fixing roller 162 and the pressing roller 163. At this time, the sheet 9 is supplied with heat by the fixing device 162 so that the toner on the sheet 9 is fused and fixed on the sheet 9. During this, a part of the moisture contained therein is evaporated or vaporized therefrom by the heat, with the result that the air within the fixing device 16 contains more vapor or moisture than in the air around the fixing device 16 or outside the image recording apparatus.

The water vapor in the fixing device 16 flows upwardly together with the warm air, but since the upper portion of the fixing device 16 is sealed by a resilient member 168 of, for example, Moltplane, the vapor moves by convection within the fixing device 16. Therefore, the warm air and the water vapor flow in the passage 167 as shown by an arrow a in the fixing device 16.

A sheet guiding member 179 disposed adjacent the discharging side of the discharging rollers 17 is perforated, or formed by a net or a plurality of guiding rods so as to allow the vapor to pass through.

The sheet 9 which has passed through the nip between the fixing roller 162 and the pressing roller 163 is discharged by the discharging rollers 17 and reaches the pawl for switching the passage for the sheet 9. At this time, the bottom side of the sheet 9 is exposed to the water vapor supplied through the vapor passage 167, immediately after the sheet 9 is discharged from the discharging rollers 17. The water vapor application is effective to correct the curling of the sheet 9 so that the sheet becomes substantially flat when it is directed toward the intermediate tray 20. Particularly when the sheet 9 is transported in the direction shown by an arrow b in the duplex mode, the treatment given to the sheet 9 by the vapor improves the state of stacking of the sheet on the intermediate tray 20 and also improves the separation of the sheet 9 from the photosensitive drum 5 after the second image transfer operation.

Figure 2A:
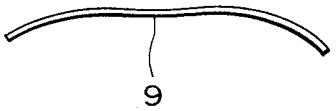
FIG. 2A is a longitudinal cross-sectional view of a sheet after passing through a heat fixing device.
Figure 2B:
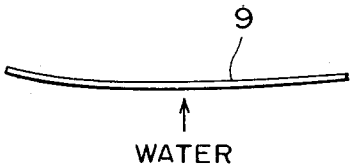
FIG. 2B is a longitudinal cross-sectional view of an example of the sheet which has been corrected in its shape according to the present invention.
Figure 3A:
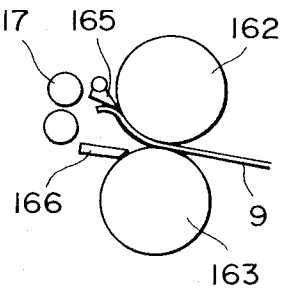
FIGS. 3A and 3B are somewhat schematic cross-sectional views illustrating the manner in which the sheet configuration shown in FIG. 2A is provided.
Figure 3B:
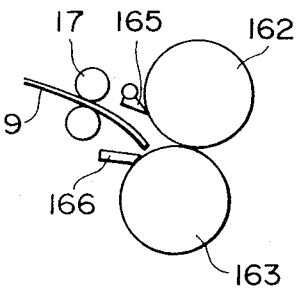

The correction or regulation of curling of the sheet 9 by the application of the vapor, will be explained in detail in conjunction with FIGS. 2A, 2B, 3A and 3C. The leading edge of the sheet entered to the nip formed between the fixing roller 162 and the pressing roller 163 is attached to the fixing roller 162 due to the adhesiveness of the fused toner, but it is peeled by the separation pawl 165. Because of this, the leading end portion of the sheet 9 is curled downwardly as shown in FIG. 3A. On the other hand, the trailing edge of the sheet 9, when it is released from the nipping action of the fixing roller 162 and the pressing roller 163, is supported only by the discharging rollers 17, so that the trailing end portions dangles due to the gravity, thus curling downwardly. As a result, the sheet 9 curls in the shape as shown in FIG. 2A, after being entirely discharged from the fixing device 16. This curling is greater when the sheet 9 contains more moisture prior to the image formation. It is thought that this is because the rigidity of the sheet 9 is decreased by the moisture content and because the movement of the moisture in the sheet 9 is at all times directed upward so that the movement of the moisture is more active adjacent to the bottom surface thereof. As will be understood in FIGS. 1 and 2, the sheet 9 is directed by the pawl 18 to the passage 104 which is bent in the same direction as the curling, and therefore, the passage 104 tends to bend the sheet 9 to promote the above-described curl of the sheet 9. It should be noted that the bening action is exerted to the sheet 1 when the sheet 9 is immediately after the fixing device 16, that is, the sheet 9 is still warm, i.e. when the sheet 9 is easily influenced so as to easily increase the above described downward curling of the sheet 9.

To prevent this, in the present embodiment, the water vapor emanated from the sheet by the heat is efficiently utilized by the application of the vapor to the concave side of the sheet 9, that is, the side, opposite to the side which bears the image, of the sheet which is curled as described above. Thus, the curl of the sheet 9 is corrected by a very simple structure. In this embodiment, when the temperature of the sheet 9 discharged from the fixing device 16 is high to a substantial extent, the air containing the water vapor having a temperature lower than the temperature of the sheet 9 impinges on the concave side of the sheet 9, so that the vapor pressure is relatively large in the concave side of the sheet 9 than in the convex side. Because of this, the vaporization of the moisture contained in the sheet 9 which is at relatively high temperature may be constrained, and the tendency of absorbing the moisture is increased at the concave side of the sheet 9, and simultaneously therewith, the amount of moisture supplied to the concave side can be made larger than the quantity of evaporation therefrom. That is, the curling may be corrected by supplying moisture to the concave side.

The inventors' experiments showed a very good curl correcting effect under the following conditions:

The temperature of the sheet 9:60°–130° C., preferably, 80°–110° C.:

The temperature of the air flow containing the vapor from the fixing device to the concave side of the sheet 9:30°–60° C., preferably 40°–50° C.:

The relative humidity of the same: 60°–100%, preferably 60–90%:

The temperature in the ambient in the convex side of the sheet 9:20°–50° C., preferably 20–40° C.

The relative humidity of the same: 60–100%, preferably 30–70%.

Since there are various members within the fixing device usually, it is sometimes possible that, with the vapor passage 167 (FIG. 4) only, the water vapor emanated from the sheet 9 concentrates on unnecessary portions.

The following embodiment is to make sure of the effect of the vapor application.

Figure 5:
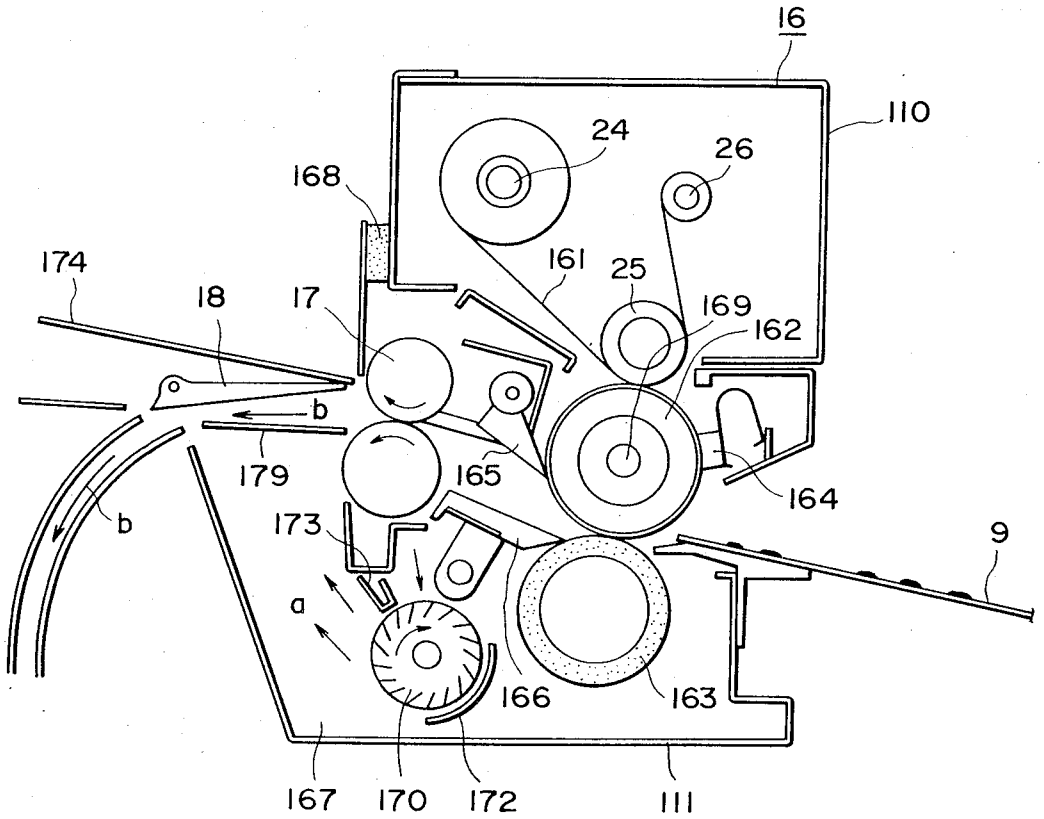
FIG. 5 is a cross-sectional view of and around the fixing device used with the recording apparatus according to another embodiment of the present invention.

FIG. 5 illustrates another embodiment of the present invention. Since this embodiment is similar to the foregoing embodiment, except for the portions which will be described, the detailed description of the similar portion is omitted for the sake of simplicity by assigning the same reference numerals to the elements having the corresponding functions. In this embodiment, a cross-flow fan 170 is provided so as to suck the water vapor in the fixing device 16 and discharge it to the bottom side of the sheet 9 after being discharged from the fixing device 16. Since the vapor application is more positive, the curl of the sheet 9 is corrected more effectively and efficiently, that is, the curl is corrected during a shorter period of time. For this reason, this embodiment is suitable for a high speed image recording apparatus.

Figure 6:
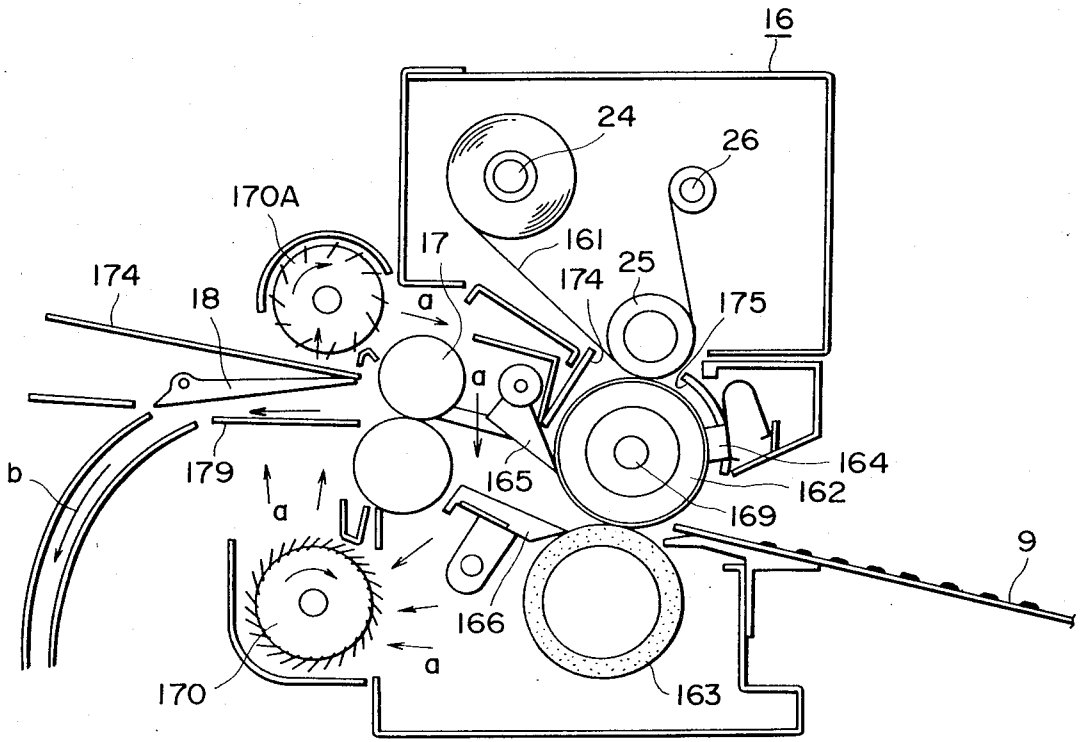
FIG. 6 is a cross-sectional view of and around the fixing device used with the recording apparatus according to a further embodiment of the present invention.

FIG. 6 illustrates a further embodiment of the present invention, which is similar to the foregoing embodiment, except for the portions which will be described, the detailed description of the similar parts is replaced by the same reference numerals assigned to the corresponding elements. In this embodiment, there are provided two cross-flow fans 170 and 170A so as to interpose the discharged sheet therebetween. The cross-flow fans 170 and 170A are rotated in the direction shown by the arrows to create the air flow shown by an arrow a. The cross-flow fan 170 is effective to suck the water vapor concentrated at the bottom of the fixing device 16 and to blow the same against the bottom side of the sheet 9, immediately after it is discharged from the fixing device. On the other hand, the cross-flow fan 170A is effective to convey the water vapor adjacent to the separation pawl to the neightborhood of the bottom of the fixing device 16 and also effective to return into the fixing device 16 the water vapor emanated from the sheet 9 immediately after it is discharged from the fixing device and the vapor discharged by the cross-flow fan 170 when there is no sheet at the discharge side of the fixing device.

By doing so, the water vapor in the fixing device 16 is positively collected and applied to the sheet 9, so that the curling of the sheet 9 can be corrected more effectively and efficiently, that is, the curling can be corrected during a shorter period of time.

In the FIG. 5 embodiment, there are provided partition plates 172 and 173 to regulate the flow provided by the cross-flow fan 170. The resistance to the air flow provided by the partition walls is effective to control the air flow at the suction side and discharge side of the fan.

In the FIG. 6 embodiment, there are provided blocking plates 174 and 175 which are effective to direct downwardly the air collected adjacent to the fixing roller 162, so as to prevent the air from being wasted by being directed toward the cleaning web. For this purpose, the blocking plates 174 and 175 cover the upper portion of the fixing roller 162.

Figure 7:
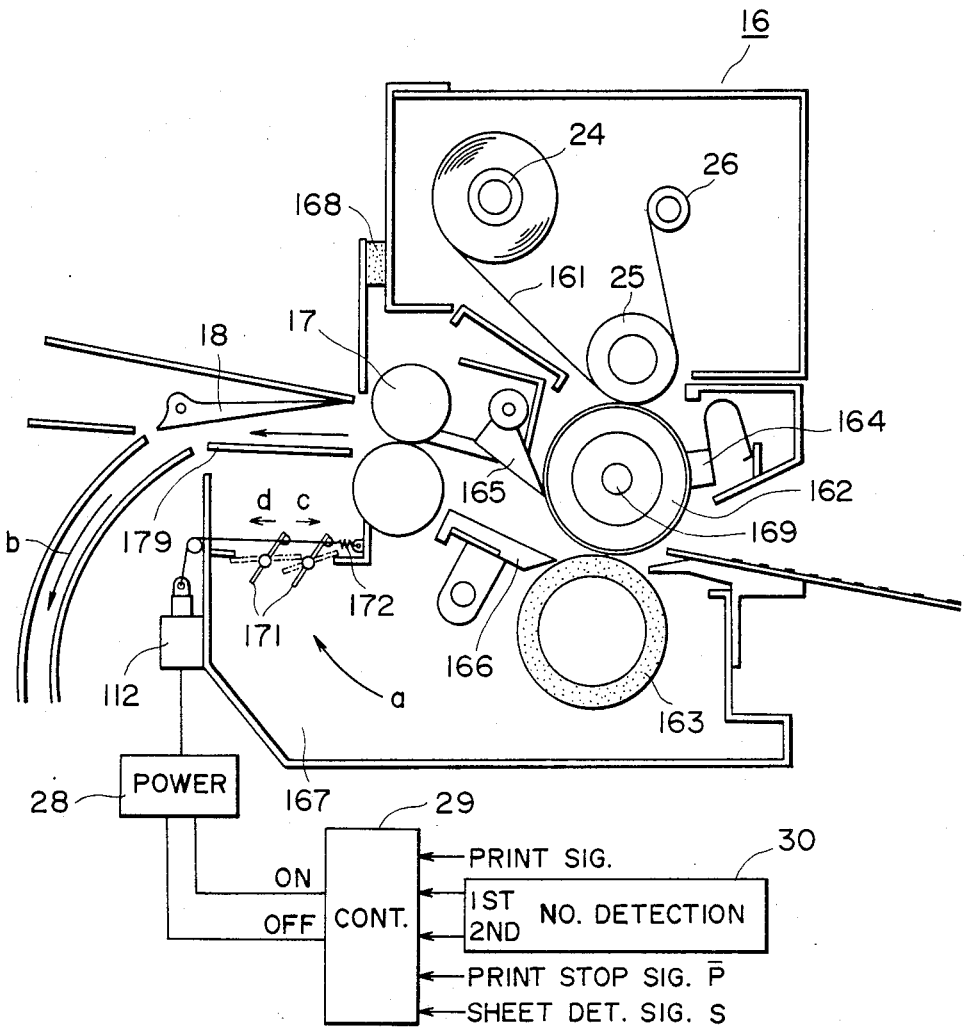
FIG. 7 is a cross-sectional view of and around the fixing device used with the recording apparatus according to a further embodiment of the present invention, wherein the application of the water vapor is controlled.
Figure 8:
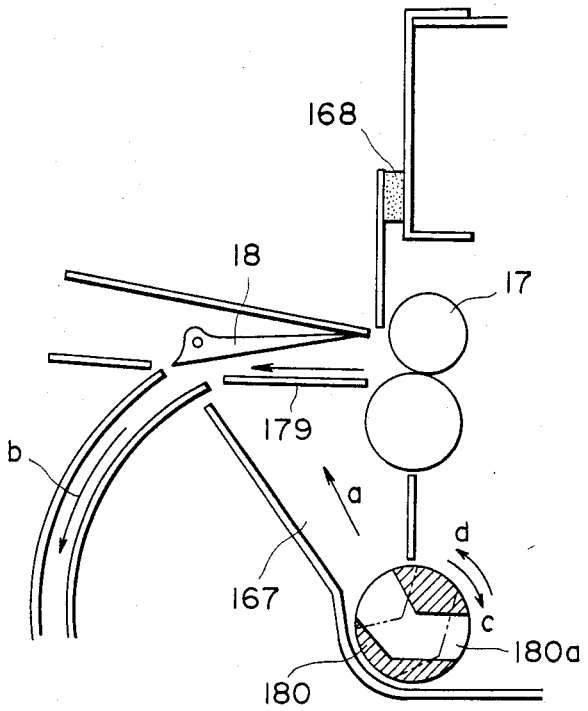
FIG. 8 is a cross-sectional view of a part of the fixing device used with the recording apparatus according to a further embodiment of the present invention, wherein the application of the vapor is controlled.
Figure 9:
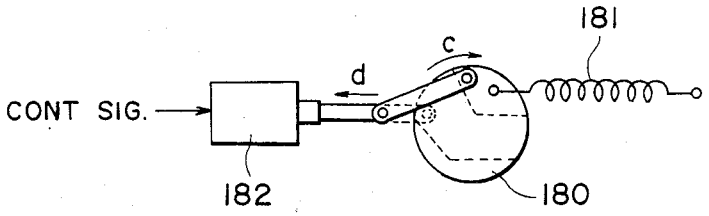
FIG. 9 illustrates a mechanism for effecting the control in the embodiment shown in FIG. 8.

FIGS. 7–9 illustrate other embodiments of the present invention, wherein the application of the vapor is controlled. When the recording operation is not carried out, or when the fixing operation is not carried out, that is, when there is no sheet to be exposed to the vapor, the water vapor passage is closed, or the flow of the vapor is restricted. And, the amount of the vapor application is changed in accordance with the number of times the recording sheet passes through the fixing device 16.

In FIG. 7 which also shows the block diagram for the control, the vapor passage is opened while the printing operation or during the sheet 9 is in the fixing device 16. Thus, the water vapor is allowed to flow. During the non-operative state of the printing operation or when no sheet 9 is in the fixing device 16, the vapor passage is closed, or the fan 170 shown in FIG. 5 is not operated. Thus, the above-described first control is performed. The second control is incorporated, noting that the quantity of moisture removed from the sheet 9 during the first passing through the fixing device 16 and that removed during the second passing are different. The amount of the vapor application is increased with the number of passings.

As shown in FIG. 7, the fixing device 16 is provided with louvers 171 which open or close the vapor passage by the plunger 112 and a tension spring 172. Normally, it closes the passage. The plunger 112 is supplied with power from the power source 28 which is controlled by a signal given by control means 29. Upon a print starting signal P generated, the plunger 112 is actuated to rotate the louver 171 in the direction shown by an arrow d, thus opening the passage 167. Upon completion of the printing, the power supply to the plunger 112 is shut, the louvers 171 rotate by the force of the spring 172 in the direction shown by an arrow c, thereby closing the vapor passage 167 (in the duplex printing mode, the louvers 171 may be rotated in the direction d for each of the printing operations, thus re-opening the vapor passage 167). Because of this structure, the water vapor is enclosed in the fixing device 16 during non-printing operation period, so that the curl correcting power at the time of the print start is increased. In order to enhance the vapor enclosure or sealing, a shutter may be provided at the inlet side of the fixing device 16. Since, however, the ordinary recording sheet is relatively thin, the moisture content of the sheet becomes very low after it passes through the fixing device 16 twice in the duplex mode printing. This makes the sheet 9 relatively rigid, so that 9 it is discharged without curling or with less curling, as compared with the case of the first passing. If such a sheet 9 receives the water vapor at its bottom surface, it is discharged with the curling of convex down shape, which is not desirable.

The present embodiment, therefore, is such that the sheet 9 receives the water vapor while it passes through the fixing device 16 the first time, while it does not receive the vapor during the second passing. More particularly, during the second passing, the plunger 112 is not energized, thus allowing the spring 172 to keep the louvers 171 at the closing position. Good image formation can be performed without obstructing the sheet transportation.

The control of the louvers 171 is as follows, for example. They are operated in response to a duplex printing detection sensor 27 (FIG. 1) disposed in the sheet transportation passage toward the intermediate tray 20, or in response to a detector 30 for detecting the number of the sheets passing through the fixing device, the detector 30 sensing the sheet transporting means and the selection of the sheet transporting passage.

FIGS. 8 and 9 are associated with another embodiment, which is a modification of the FIG. 7 embodiment. In this embodiment, there is provided a rod-like shutter member 180 for opening and closing the passage. The rod-like member 180 is rotatable about its axis and provided with a passage **180*a* as shown in FIG. 8. The member 180 is rotatably supported at the boundary between the bottom of the fixing device 16 and the vapor passage 167. The member 180 is normally urged in the direction of an arrow c, that is, the clockwise direction by a spring 180, as shown in FIG. 9, thus taking the vapor passage closing position wherein the pasage 180*a* is as shown in FIG. 8 by chain lines. Upon the print start signal, a plunger 182 is energized to rotate the rod-like member 180 in the direction of arrow d, and the passage 180*a* takes the position shown by the solid lines in FIG. 8, that is, the vapor passage 167** is opened.

As a further preferable alternative, the cross-flow fan or fans shown in FIGS. 5 and 6 may be controlled by the control system shown in FIG. 7. When the sheet 9 passes through the fixing device 16 for the first time, the water vapor in the fixing device 16 is more positively collected and given to the sheet 9, thus further increasing the curl correcting performance. During the sheet 9 passing therethrough for the second time, the cross-flow fan 190 is stopped so as to substantially close the passage 167, thus stopping the water vapor application to the sheet 9. It is possible to drive the cross-flow fan 190 by a variable speed motor, whereby the flow rate of the vapor is made different between the first passing of the sheet 9 and the second passing thereof so as to decrease the vapor application for the second time.

Figure 10:
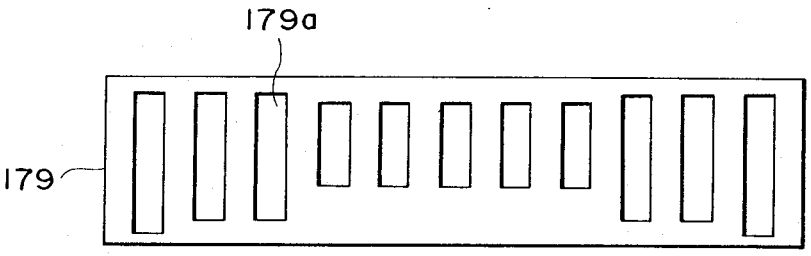
FIG. 10 is a plan view of a structure for non-uniformly applying, the vapor.
Figure 11:
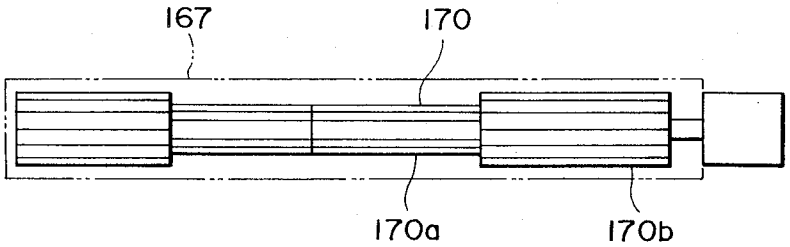
FIG. 11 is a plan view of another structure for non-uniformly applying the vapor.

FIGS. 10 and 11 illustrate further embodiments, wherein the water vapor is applied to the sheet non-uniformly in the direction of the width of the recording member, immediately after it is discharged from the fixing device. In the foregoing, the sheet curling in the longitudinal direction, that is, the direction along the transportation thereof, has only been dealt with, but actually, there is the sheet curling in the perpendicular direction, that is, perpendicular to the direction of the sheet transportation. The embodiment shown in FIGS. 10 and 11 are intended to deal with such curling.

FIG. 10 is a plan view of the sheet guiding member 179 shown in FIG. 2. The guiding member 179 is provided with openings **19*a* whose areas are larger toward the opposite ends thereof so that a larger amount of vapor is applied adjacent the lateral ends of the sheet 9** passing on the sheet guiding member 179. This is effective to correct curling of the sheet 9 adjacent the lateral ends as well as adjacent the leading and trailing ends. The curling adjacent the lateral end are similar to the longitudinal curling which has been described in conjunction with FIG. 2A, that is, it is concave down. The reason for this is thought to be that the pressure given to the sheet 9 by the fixing roller 162 and the pressing roller 163 is larger adjacent the lateral end than at the central portion and that the heat transfer from the sheet 9 is also more active adjacent the lateral end portions than the central portions because of the above difference in the pressure to the sheet 9. The lateral curling which may be produced in this manner can be corrected by giving more vapor to the lateral end portions than to the central portions.

FIG. 11 shows an alternative, wherein the cross-flow fan 170 has different diameters along the axis thereof but is driven by a common motor 171. More particularly, the diameter is larger at the end portions **170*b* than the central portions 170*a*, so that more vapor impinges on the lateral end portions of the sheet 9**. This is effective to correct lateral curling as well as the longitudinal curling. This embodiment is suitable for a high speed image recording apparatus.

Figure 12:
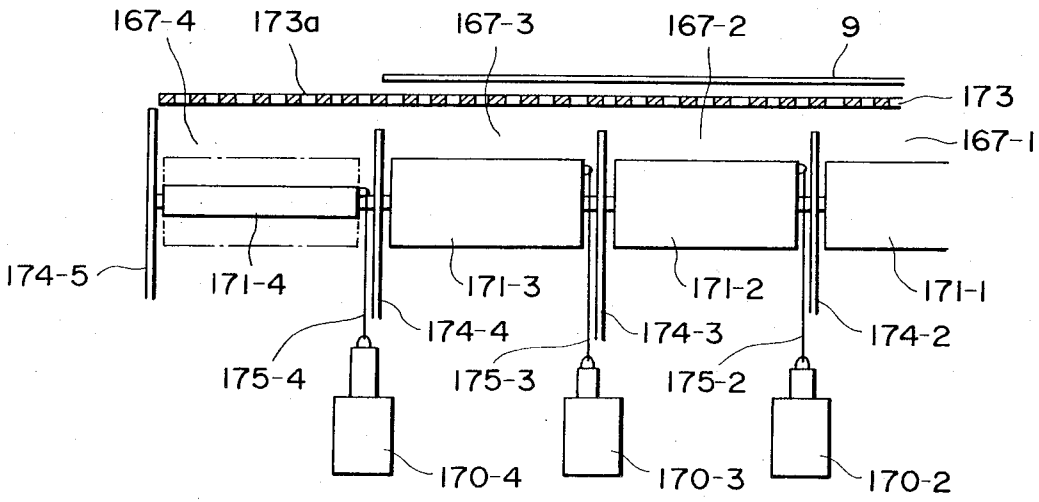
FIG. 12 illustrates a structure for limiting the vapor application area.
Figure 13:
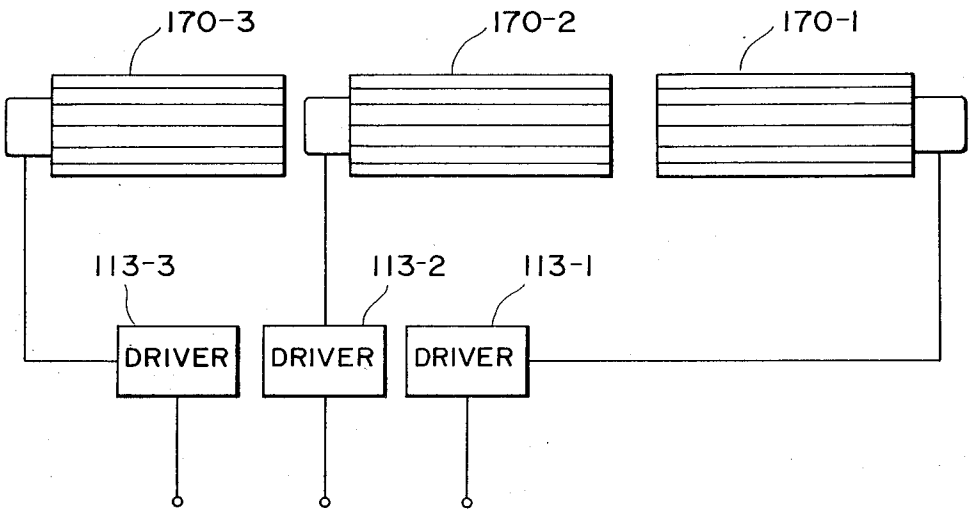
FIG. 13 illustrates another example of structure for limiting the vapor application area.
Figure 14:
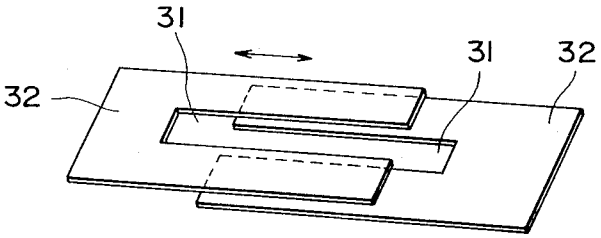
FIG. 14 is a perspective view of a further example of the structure for limiting the vapor application area.

FIGS. 12–14 relate to further embodiments, which solve an additional problem which may be involved in the foregoing embodiments. In the foregoing structures or arrangements, when the area of the vapor application is wider than the width of the sheet 9, such as when the sheet 9 has the width which is smaller than the width of the vapor passage 167, the vapor flows more to the area without the sheet than to the area with the sheet. In addition, the vapor which passed through the sheet guiding member 173 at the sheet absence region can reach around the lateral edges of the sheet to the top side of the sheet 9. This results in a local unbalance of the applied vapor, which causes different deformation between the end portions and central portions. This may be another cause of the curling.

In FIGS. 12–14 embodiments, the portion of the vapor passage which is absent of the sheet is closed to further ensure the curl prevention with the additional advantage of preventing the wasteful consumption of the vapor. This is accomplished by vapor application width controlling means which is operable in response to the size of the recording sheet. This control means changes the effective vapor application width.

In the FIG. 12 embodiment, the water vapor passage 167 is divided into plural passages in the direction of the width by a plurality of partitions 174-1 174-5 (the partition 174-1 is not shown), thus providing divided plural passages 167-1–167-4 which are independent from each other. Each of those independent passages 167-1–167-4 is provided with each of the louvers 171-1–171-4, which are also independent. Each of the louvers is acted upon by a spring 172 which urges the louver to its closing position. The respective louvers are connected to the respective plungers 170-1–170-4 (the plunger 170-1 is not shown) through the respective wires 175-1–175-4 so as to be opened or closed thereby. The sheet size signal provided by the sheet accommodating cassette loaded into the image recording apparatus is given to the planger means so that the plangers 170-1–170-4 are controlled to open the vapor passage 167 correspondingly to the size of the sheet used. FIG. 12 shows the state wherein the louvers 171-1–171-3 are opened while the louver 171-4 is closed. In this state, no vapor flow exists through the passage 167-4 which is outside the sheet 9 width, and therefore, the vapor is not wasted and more importantly, the above described curling can be prevented.

In the FIG. 13 embodiment, the cross flow fan 170 for sucking the vapor from the fixing device 16 and blowing the same against the bottom surface of the sheet 9 just discharged from the fixing device 16, is divided into a plurality of short cross-flow fans 170-1–170-3 arranged in alignment with each other. The short cross-flow fans are selectively operated in accordance with the sheet size by the drivers 113-1–113-3 to which the sheet size signal is inputted. The water vapor is more effectively and efficiently blown against the sheet 9, with the result of more remarkable curl correction. Since this can correct the curling at higher speed, and therefore, this is suitable for a high speed image recording apparatus.

FIG. 14 shows a further alternative of the means for changing the vapor application width, wherein a variable width slit is disposed across the vapor passage 167. The variable width slit is formed by two slit plates 32 overlapped to provide a slit opening 31. At least one of the slit plate 32 is moved in the direction shown by an arrow in response to the width of the sheet so as to change the length of the slit in response to the width of the sheet.

According to the embodiments of FIGS. 12, 13 and 14, the effective width of the water vapor passage is changed in response to the width of the sheet used (size) at a location adjacent to the sheet discharging side of the image fixing device 16, thereby preventing the additional curling and simultaneously preventing the wasteful consumption of the vapor.

Next, a description will be made as to the desirability of the control depending on the nature or state of the recording material, the term "nature" or "state" includes the thickness, material and moisture or water content of the recording material). It has been confirmed that, when the curl of the sheet is corrected by the vapor application, the amount of the expansion of the bottom of the sheet changes with the amount of the vapor applied thereto. Therefore, to provide the optimum correction of the curl of the discharged sheet 9, it is preferable to control the quantity of the vapor applied to the bottom of the sheet in accordance with the nature or the state of the sheet 9. The sheet 9 having a larger moisture content, as in the case of the sheet kept in a high humidity condition, results in a greater concave down curling, and a larger quantity of vapor is needed to correct such a curl. Usually, a thick sheet which is rigid does not curl when it is discharged from the fixing device. However, because of insufficient heat tranfer between the top and bottom surfaces of the sheet, it is possible that the water or moisture evaporates only at the top surface thereof which are directly contacted to the fixing roller, resulting in a concave up curling. In such an occasion, the vapor application to the bottom surface of the sheet is not preferable, because it would increase the curl. Means for detecting the nature or state of the sheet will be described.

Figure 15:
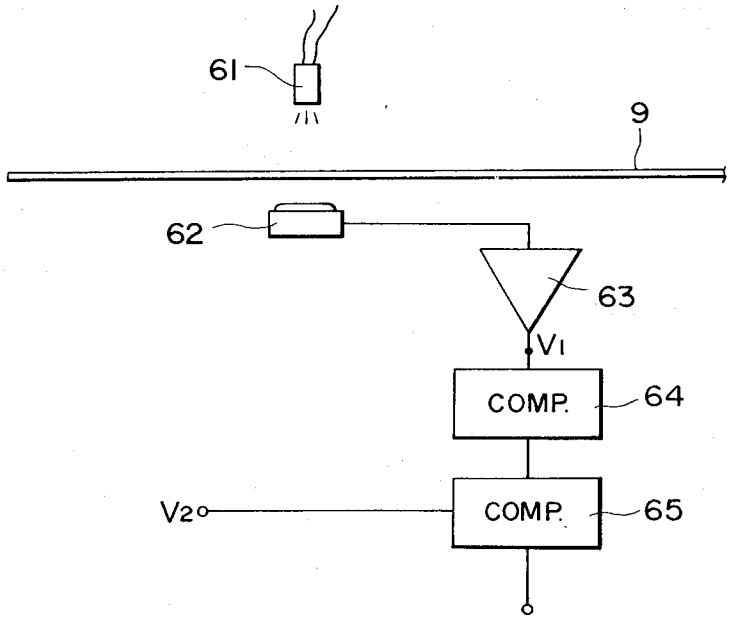
FIGS. 15 and 16 illustrate examples of the means for detecting a state or nature of the recording material.

FIG. 15 shows an example of a mechanism for detecting the kind and nature of the sheet, particularly the thickness and the moisture content of the sheet. The mechanism includes a light source 61 and a photodiode 62 adapted to receive therebetween the sheet 9 so that the mechanism can detect the light amount passing through the sheet 9. Since the amount of the light passing through the sheet 9 changes with the thickness of the sheet 9, the output of the photodiode 62 bears the information of the sheet thickness. The output of the photodiode 62 is supplied to the driver 173 (FIG. 2) or to the driver 183 (FIG. 13) through an amplifier 63, a comparator 64 and a control circuit 65 (which are known, so that the quantity of the vapor given to the sheet 9 is controlled, that is, the vapor quantity is decreased with the increase of the thickness).

Figure 16:
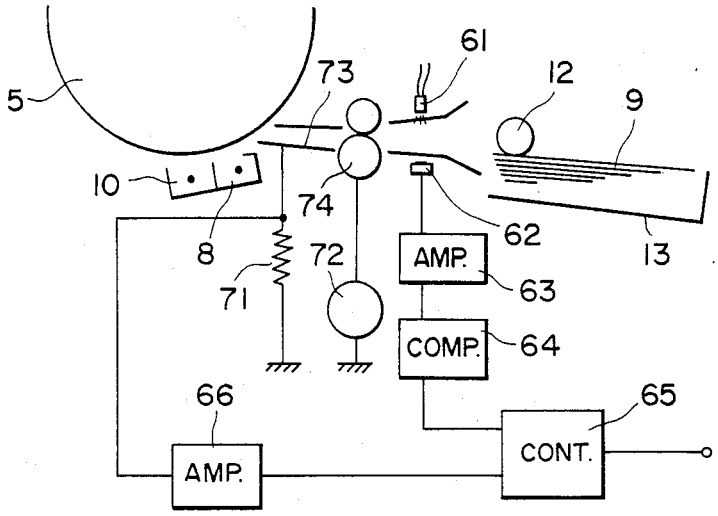

FIG. 16 shows an example of a mechanism for detecting the thickness of the sheet and the state of the moisture content. When the sheet 9 is fed out of the cassette 13 by the feeding roller 12, the thickness of the sheet 9 is detected by the sheet thickness detecting mechanism as shown in FIG. 15. Then the sheet 9 is temporarily stopped and fed by a couple of registration rollers 74 in synchronism with the rotation of the photosensitive drum 5. And then, the sheet 9 is transported along the transfer guide 73 to the transfer station wherein it is subjected to the transfer charger 8.

To the registration roller 74, a bias voltage (preferably, the same polarity as that of the transfer charger 8) is applied by a bias source 72. The transfer guide 73 is grounded through a resistor 71. Thus, the electric resistance of the sheet 9 is detected by detecting the current flowing from the registration roller 74 to the transfer guide 73 through the sheet 9. Therefore, the state of the moisture content of the sheet can be known, as the voltage drop through the resistor 71.

The output voltage of the photodiode 62 representative of the thickness of the sheet 9 is transmitted to the control circuit through the amplifier 63 and the comparator 64. The voltage drop through the resistor 71 representative of the moisture content of the sheet 9 is transmitted to the control circuit 65 through the amplifier 66. The control circuit 65 produces, in response to the two inputs, the control signal for controlling the quantity of the vapor to be applied to the sheet 9.

More particularly, the signal $V_1$ of the photodiode 62, after passing through the amplifier 63, is compared with a reference voltage $V_0$ by the comparator 64. If $V_1 > V_0$ (the thickness of the sheet 9 is small, and the amount of the passing light is large), the output of the comparator 64 is "1". If $V_1 < V_0$ (the thickness of the sheet 9 is large, and the amount of the passing light is small), the output of the comparator 64 is "0".

The other signal $V_2$, representative of the moisture content of the sheet 9, is obtained by amplifying the voltage drop through the resistance 71. If the output signal $V_2$ is large, the resistance of the sheet 9 is low, that is, the moisture content is large. On the contrary lower signal $V_2$ means the high resistance of the sheet 9, that is, the moisture content is not large.

Figure 17:
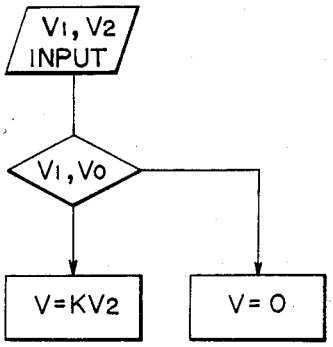
FIG. 17 is a block diagram for detecting the state or nature,of the recording material.

The final control signal is produced in this manner. As shown in FIG. 17, if $V_1 > V_0$, that is, if the output of the comparator 64 is "1", the control signal is proportional to the signal $V_2$. If $V_1 < V_0$, the control signal is "0".

The controlling operation will be described with the cross-flow fan control. The cross-flow fan is controlled to change the flow rate by the output of the driver which is controlled by the above described control signal V. The driver is such that when the control signal V is "0" (sufficiently thick sheet), the cross-flow fan 190 is shut down; and with the increase of the control signal V (thick sheet with high moisture content, low resistance), the flow rate of the cross-flow fan 190 is increased.

As a result, the curling is corrected with certainty regardless of the kinds, nature or state of the sheet. In addition, the amount of the vapor supplied from the fixing device 16 is properly controlled, so that the vapor is not wasted and effectively used for correction of the curling.

Figure 18:
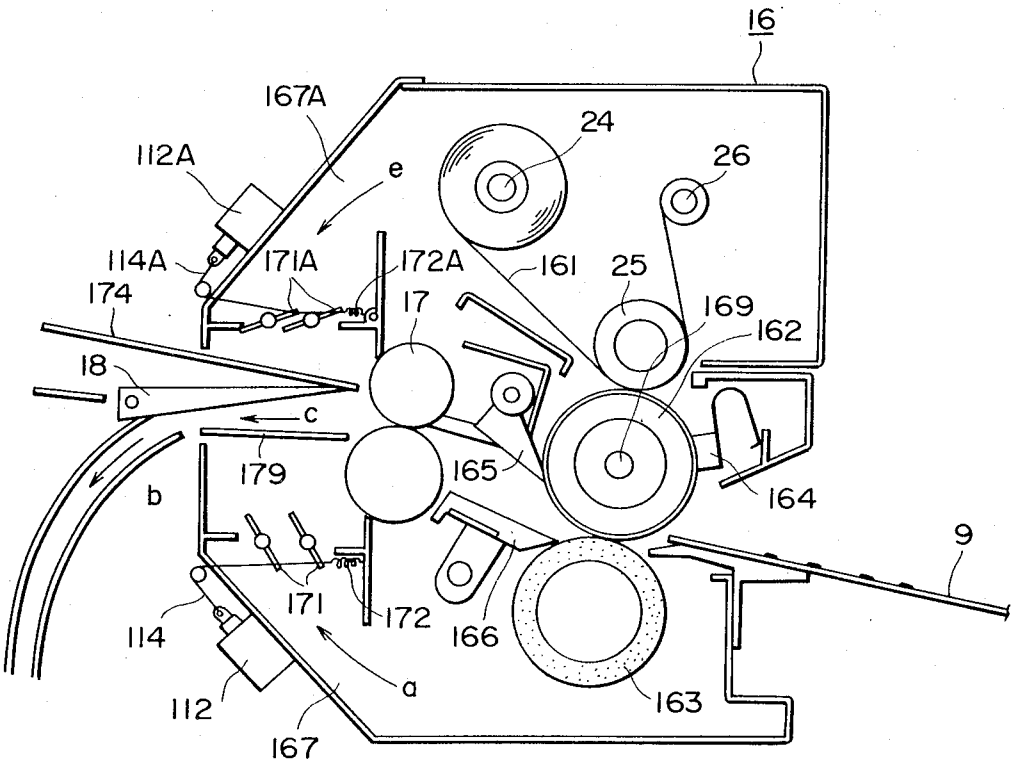
FIG. 18 is a cross-sectional view of and around the image fixing device used with the recording apparatus according to a further embodiment of the present invention.
Figure 19:
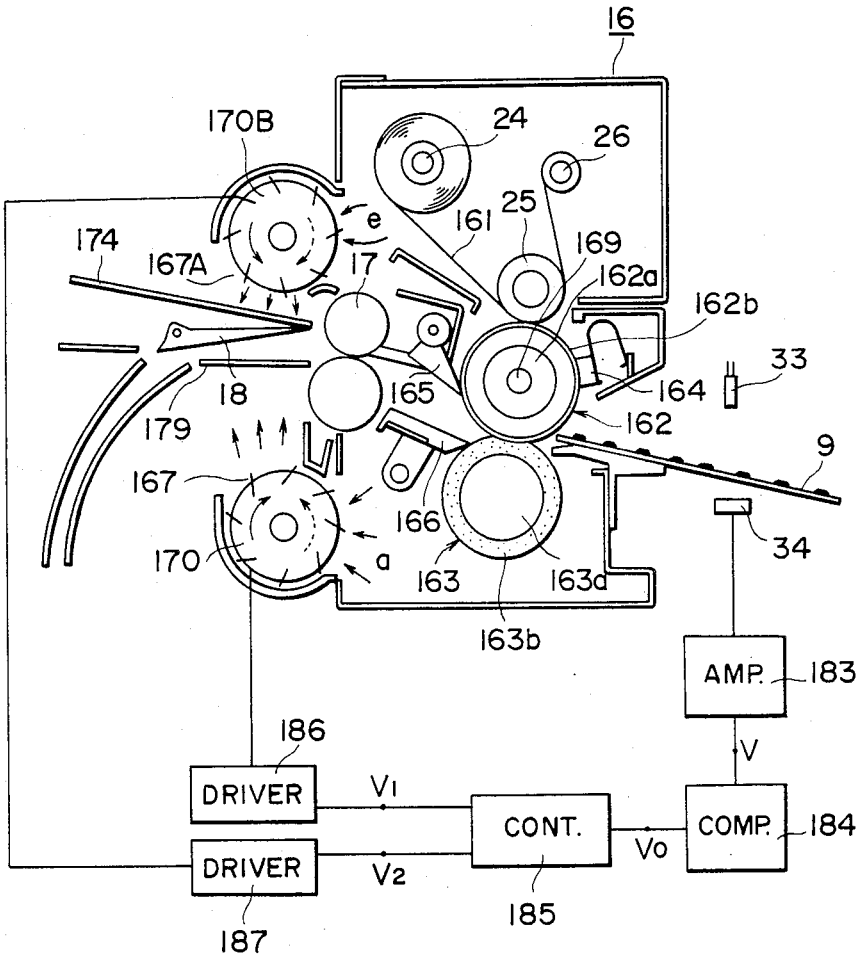
FIG. 19 is a cross-sectional view of and around the image fixing device used with the recording apparatus according to a further embodiment.

FIGS. 18 and 19 illustrate further embodiments whereby the curl is corrected into a desirable states as well as removing the curling.

To achieve this, the embodiments are provided with vapor passages toward either side of the recording sheet adjacent to the discharging side of the fixing device so as to apply the vapor to both sides of the recording sheet, and a flow changing mechanism for changing the flow of the vapor in the respective passages independently from each other. Those embodiments are effective to change the curl into a desired state, if necessary, and to remove the curl with more certainty.

FIG. 18 is an improvement of the embodiment shown in FIG. 7. Two passages 167 and 167A are formed as lower and upper vapor passages divided by the sheet transportation passage and are extended from the lower and upper part of the apparatus to the neighborhood of the sheet discharging side, preferably to the outside of the discharging rolls 22. Those passages 167 and 167A are formed by inclining toward the discharging side the bottom and top wall of the fixing device 16. Similarly to the FIG. 7 embodiment, there are provided in the vapor passage 167, a louver 171 a spring 172 and a plunger 112 connected by a wire 114 to the louver 171 for opening the louver 171 against the spring force. Similarly, the vapor passage 167A is provided with a louver 171A, a spring 172A, a wire 114A and a plunger 112A.

An example of control in the duplex mode will be described. This is different from the ones described above and more suitable to the sheets widely used in The United States of America, which are relatively thick.

During the fixing operation for the first side of the sheet 9, the plunger 112A is not energized, and only the plunger 112 is energized. Therefore, the louver 171A assumes its closing position by the spring 172A. The louver 171, however is opened as shown by the force of the plunger 112 given through the wire 114 against the spring force by the spring 172.

The sheet 9, which has passed through the nip between the fixing roller 162 and the pressing roller 163, is discharged from the discharging roller couple 17 and then directed as shown by an arrow b by the pawl 18 for changing the sheet passage. During this, the sheet 9 is exposed to the water vapor at its bottom surface, immediately after it is discharged from the roller couple 17, the vapor flowing through the vapor passage 167 (opposed to the passage 167A) in the direction shown by an arrow a. The vapor application corrects the curl so that the sheet 9 is substantially flat when it is received by the intermediate tray 20. Therefore, the recording sheet 9 is stacked on the intermediate tray 20 in good order, and the recording sheet is separated from the photosensitive drum 5 under good conditions when it is transported thereto for the second side image formation.

When the sheet 9 passes through the fixing device 16 after its second side receives the toner image, the plunger 112A is energized, while the plunger 112 is not energized. Therefore, the louver 171 takes its closing position by the spring 176. The louver 171A, however, takes the open position by the force of the plunger 114A given to the louver 171A through the wire 114A against the spring force. Because of those positions of the louvers, the water vapor within the fixing device 16 flows from the upper part thereof in the direction shown by an arrow e so that the vapor is applied to the upper side of the sheet 9 (the side on which the second image is formed).

When the sheet 9 passes through the fixing device 16 for the second time, the moisture content of the sheet 9 has been decreased. When the sheet 9 in such a state is heated by the fixing roller 162, only the vapor that exists adjacent the surface thereof is removed, whereby the upper surface of the sheet 9 tends to shrink, with the result of concave up curling in the longitudinal direction. If the sheet 9 is discharged with this state, it is not stacked on the tray in good order because of its convex down shape. That is, it will cause inconveniences in accommodating the sheets in a sorter or on a stacker. Such undesirable curling can be prevented by applying a water vapor to the upper surface of the sheet 9 during the second passing.

It will be understood that if the above described control is used with the fans 170 and 170B shown in FIG. 19, the results are better, in consideration of the foregoing description.

Figure 20:
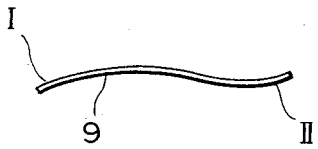
FIG. 20 is a longitudinal cross-sectional view of a sheet having a shape which is preferable.
Figure 20B:
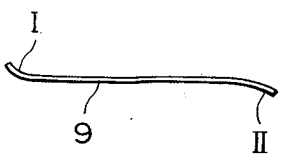
Figure 20A:
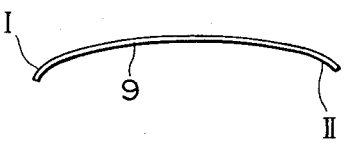

FIG. 19 is another embodiment wherein the control is changed between the duplex printing mode and the superimposing printing mode, and wherein cross-flow fans 170 and 170B are used in place of the louvers of FIG. 18. Generally, the curl is as shown in FIGS. 20*a* and FIG. 20*b* if there is no means for the curl correction immediately after the fixing device. In the case of FIG. 20*a*, the portion indicated by a reference I curls down, that is, away from the photosensitive drum 5, and therefore, it is convenient for the separation from the drum 5 in the superimposing printing mode, but it is incovenient in the duplex printing mode because the portion designated by a reference II is curled toward the drum 5. This is similar to the case of FIG. 2A. The curl shown in FIG. 20*b* is inconvenient both for the superimposing printing and duplex printing because the portions I and II are curled toward the photosensitive drum which will be along with the photosensitive drum surface. This curl occurs depending on the kind of the sheet 9 and the state of the toner supported on the sheet, when the leading edge of the sheet is separated from the fixing roller 162 without the action of the separation pawl 165. On such occasion, the state of the toner image on the sheet 9 is sensed by the density of the original to be reproduced, the rate of the developer consumption or the density of the developed image. Those can be effected by known toner state detecting means. Thus, the state of the toner image is discriminated, which is taken into the consideration of the vapor application. A specific example will be described.

At the inlet side of the fixing device 16, there are provided a light source 33 and a photodiode 34 opposed to each other in such a manner as to interpose the sheet transportation passage, so that the light from the light source 33 is detected by the photodiode 34. The output of the photodiode is transmitted to a comparator 184 through an amplifier 183. The reference signal is set within the comparator 184. The output $V_0$ of the comparator 184 is "1" when the output of the photodiode 182 is high enough (no sheet 9). The control circuit 185 receive the output $V_0$ and produces control signals $V_1$ and $V_2$ so as to actuate the driver 186 and deactivate the driver 187. When there is a sheet 9, so that the output of the photodiode 34, and therefore, the output V of the amplifier 183 is low, the outut $V_0$ of the comparator 184 is "0". The control circuit 185 produces control signals $V_1$ and $V_2$ so as to deactivate the driver 186 and actuate the driver 187.

Therefore, without the sheet passing through, and after the sheet 9 passes between the light source 33 and the photodiode 34, the cross-flow fan 170 rotates in the direction shown by the arrow. Otherwise, the other cross-flow fan 170*b* rotates in the direction shown by the arrow. As a result, the sheet 9 which has passed through the fixing device 16 is in the curling state as shown in FIG. 20. This is advantageous in the second and subsequent image tranfer and sheet separation steps. This is remarkable particularly when the sheet 9 is separated electrostatically. In the superposing printing mode, the sheet is transferred from the portion I, and the sheet 9 is curled away from the photosensitive drum, so that the sheet 9 is easily separated from the drum. In the duplex printing mode, the portion designated by II is the leading edge so that it is very convenient for the separation thereof from the drum.

According to the present invention, it is possible to apply the vapor to the top surface of the sheet 9 at an adjacent the leading edge thereof, while the vapor is applied to the bottom surface thereof at and adjacent the trailing edge thereof. By doing so, the leading end portion curls down, while the trailing end portion curls up. This is the most desirable curling for the second image transfer and sheet separation, as described inconjunction with FIG. 20. This is achieved by controlling the operation timing and flow rate of the cross-flow fans 170 and 171 which are provided upper side and lower side, respectively. Further, in order to enhance the vapor correcting function, the cross-flow fan 170 is reversed as shown by the broken line arrow during the operation of the other cross-flow fan 170*b*. And, during the operation of the cross-flow fan 170, the other cross-flow fan 170*b* is reversed.

In order to achieve the functions of the present invention, it is preferable that the relation between the temperature of the sheet 9 discharged from the fixing device 16, the vapor pressure in the concave side of the sheet 9 and that in the convex side thereof, is within a predetermined region. This is because the balance between the moisture evaporated from the sheet 9, the moisture supplied to one side of the sheet and the moisture supplied to the other side, is determined by the relation among the above described three parameters, so that the amount of the curl correction changes with the relation between the three parameters.

Besides those parameters, when the temperature of the sheet 9 is 130° C. or higher, the amount of vaporization from the sheet 9 is too much, while the sheet temperature of 60° C. or lower result in less active movement of the moisture, so that the moisture content at the concave surface and that at the convex surface become too much. Therefore, the amount of the vapor used for the curl correction is preferably made variable for individual apparatus. Further, when the temperature is too low, the application of a proper amount of the vapor may results in the water condensing on the sheet 9, and therefore, the quantity of the vapor supply and the temperature is preferably determined in view of those. From this standpoint, the temperature of the sheet in the vapor application region is preferably higher than 60° C. and lower than 130° C. The rotational speed of the fan is practically 2100–3000 rpm.

As described in the foregoing, the present invention provides an image recording apparatus wherein the noxious curling of the sheet can be corrected to improve the sheet transportation operation with a simple structure and to improve the operations in various mode. The present invention covers various combinations of each of the embodiments for respective purposes.

While the invention has been described with reference to the structures disclosed herein, it is not confined to the details set forth and this application is intended to cover such modifications or changes as may come within the purposes of the improvements or the scope of the following claims.

What is claimed is:

1. An image recording apparatus, comprising:
means for forming an unfixed image on a recording material;
means for heat-fixing the unfixed image on the recording material; and
means for applying water vapor emanated by heating the recording material by the heat-fixing means to the recording material after being subjected to the heat-fixing operation, wherein the recording material absorbs the water vapor applied thereto to correct its shape.

2. An apparatus according to claim 1, wherein said heat fixing means includes a casing provided with an opening for allowing entrance of the recording material, heating means provided within said casing, and wherein the vapor is stored in said casing and used for the application to the recording material.

3. An apparatus according to claim 2, wherein said apparatus includes an outer housing for defining a boundary between the outside and the inside thereof, and wherein said casing is inside the outer housing.

4. An apparatus according to claim 3, wherein said vapor applying means includes a vapor passage for applying the vapor to the recording material inside the image recording apparatus.

5. An apparatus according to claim 4, wherein said vapor applying means includes means for forcing the water vapor within said casing to said vapor passage.

6. An apparatus according to claim 2, wherein said heat-fixing means includes within said casing a first rotatable member which is heated by said heating means and which is adapted to contact the unfixed image, and a second rotatable member for pressing the recording member to said first rotatable member, said vapor applying means includes a vapor passage for mainly applying the vapor from the second rotatable member side to the side of the recording material opposite to the side on which the image is fixed.

7. An apparatus according to claim 6, wherein said vapor applying means includes means for forcing the vapor within said casing to said vapor passage.

8. An apparatus according to claim 7, wherein said forcing means includes means for collecting the vapor which is applied to the recording material but not absorbed by the recording material, into said casing.

9. An apparatus according to claim 2, wherein said vapor applying means is provided with means for preventing loss of the vapor.

10. An apparatus according to claim 9, wherein said preventing means prevents the vapor from escaping from said casing not during the recording operation of said recording apparatus or not during the fixing operation of said heat-fixing means.

11. An apparatus according to claim 10, wherein said escape preventing means is included in said vapor applying means to control a vapor passing area in the vapor passage or the amount of the vapor through the passage.

12. An apparatus according to claim 1, wherein an amount of the vapor applied to the recording material by said vapor applying means is different in the central portion of the recording material than in the marginal portions with respect to width thereof.

13. An apparatus according to claim 5 or 7, wherein said forcing means includes a fan.

14. An apparatus according to claim 1, further comprising a pair of discharging rollers for discharging the recording material after the image is fixed by said heat-fixing means, wherein said vapor applying means applies the vapor to the recording material at a position downstream of said discharging roller pair with respect to advance of the recording material.

15. An apparatus according to claim 1, wherein said unfixed image forming means includes as an operating mode a superimposing mode wherein a plurality of unfixed image forming operation is effected onto one side of the recording material; and wherein said vapor applying means, in the superimposing mode, applies the vapor to the image bearing side of the recording material adjacent its leading edge after a first image is formed thereon.

16. An apparatus according to claim 1, wherein a passage for transporting the recording material is divided into plural passages at a certain point, wherein said vapor applying means applies the vapor to the recording material in a position between said dividing point and a discharge portion of said heat-fixing means.

17. An image recording apparatus, comprising:
means for forming an unfixed image on a recording material;
means for heat-fixing the unfixed image on the recording material, said heat-fixing means including a casing provided with an opening for allowing entrance of the recording material, heating means within said casing, and wherein the vapor is stored in said casing and used for application to the recording material; and
means for applying water vapor emanated by heating the recording material by the heat-fixing means to the recording material after being subjected to the heat-fixing operation, wherein the recording material absorbs the water vapor applied thereto to correct its shape;
wherein said image recording apparatus is capable of recording on different sizes of the recording material, wherein said vapor applying means is provided with means for changing the area in which the vapor is applied, in accordance with the size of the recording material.

18. An apparatus according to claim 17, wherein said vapor applying area changing means includes means for preventing loss of the vapor consumed for the area outside the width of the recording material.

19. An image recording apparatus, comprising:
means for forming an unfixed image on a recording material;
means for heat-fixing the unfixed image on the recording material; and
means for applying water vapor emanated by heating the recording material by the heat-fixing means to the recording material non-uniformly with respect to the direction of the width of the recording material after being subjected to the heat-fixing operation, wherein the recording material absorbs the water vapor applied thereto to correct its shape, wherein said vapor applying means includes a lateral control means for applying more vapor to the neighborhood of the lateral end of the recording material than to the central portions of the recording material.

20. An apparatus according to claim 19, wherein said lateral control means includes a limiting member having plural openings for allowing passage therethrough of the vapor, the openings has larger areas adjacent the lateral ends of the recording material than at the central portions thereof.

21. An image recording apparatus, comprising:

means for forming an unfixed image on a recording material;

means for heat-fixing the unfixed image on the recording material; and means for applying water vapor emanated by heating the recording material by the heat-fixing means to the recording material after being subjected to the heat-fixing operation, wherein the recording material absorbs the water vapor applied thereto to correct its shape;

wherein said unfixed image forming means includes as an operation mode a duplex mode wherein images are formed on respective sides of the recording material; and wherein said vapor applying means, in the duplex mode, applies, after an image is formed on one side of the recording material, the vapor to the non-image-bearing side of the recording material adjacent the trailing edge of the recording material.

22. An image recording apparatus, comprising:

means for forming a first image on a recording material and forming a second image on the same recording material;

means for heating the recording material a plurality of times to fix the images on said recording material; and means for applying to the recording material vapor which is emanated from the recording material when it is heated to fix the image, after the first image is fixed on the recording material and after the second image is fixed on the recording material, wherein the vapor is applied in different manners between after the first image fixing and after the second image fixing.

23. An apparatus according to claim 22, wherein the first image formation and the second image formation are effected to a first side of the recording material and a second side thereof, respectively, and wherein said vapor applying means applies the vapor to the second side of the recording material after the first image is fixed on the first side of the recording material, and applies the vapor to the second side of the recording material after the second image is fixed on the second side of the recording material.

24. An apparatus according to claim 22, wherein said vapor applying means applies the vapor to the recording material after the fixing of the first image on the recording material, but does not apply the vapor thereto after the fixing of the second image.

25. An apparatus according to claim 24, wherein said heat-fixing means includes a heating roller and a pressing roller, the heating roller being adapted to contact the image to be fixed, and wherein said vapor applying means includes a passage for the vapor for applying from the pressing roller side to the side of the recording material not contacted to the heating roller, said passage being controlled to apply the vapor to the recording material in the first image recording but not to apply the same to the recording material in the second image recording.

26. An image recording apparatus, comprising:

means for forming an unfixed image on a recording material;

means for heat-fixing the unfixed image on the recording material; and means for applying, after the recording material is subjected to the fixing operation of said heat-fixing means, to the recording material vapor which is emanated from the recording material when heated by said heat-fixing means, said vapor applying means including a first vapor applying mechanism provided in one side with respect to a passage for transporting the recording material and a second vapor applying mechanim in the opposite side; and means for controlling quantities of the vapor applied by said first mechanism and said second mechanism to change the recording material into a desired shape.

27. An apparatus according to claim 26, wherein said controlling means controls said first mechanism and said second mechanism independently from each other.

28. An image recording apparatus comprising:

means for forming an unfixed image on a recording material;

means for heat-fixing the unfixed image on the recording material; and means for applying, after the recording material is subjected to the fixing operation of said heat-fixing means, to the recording material vapor which is emanated from the recording material when heated by said heat-fixing means said vapor applying means including a first vapor applying mechanism provided in one side with respect to a passage for transporting the recording material and a second vapor applying mechanism in the opposite side; and means for controlling quantities of the vapor applied by said first mechanism and said second mechanism, independently from each other, to change the recording material into a desired shape;

wherein said unfixed image forming means includes as operation modes a superimposing mode wherein two images are formed on the same side of the recording material and a duplex mode wherein images are formed on both sides of the recording material, and wherein said controlling means controls said first and second mechanisms to apply the vapor to the recording material in different manners in response to the mode selected.

29. An image forming apparatus, comprising:

means for forming an unfixed image on a recording material;

means for heat-fixing the unfixed image on the recording material;

means for applying to the recording material vapor which is emanated from the recording material when heated by said heat-fixing means; and controlling an amount of the vapor application by said vapor applying means depending on the nature of the recording material before it is heated.

30. An apparatus according to claim 29, wherein the amount of application is changed depending on the thickness and/or the moisture content of the recording material.

31. An image forming forming apparatus, comprising:

means for forming an unfixed image on a recording material;

means for heat-fixing the unfixed image on the recording material; and means for applying water vapor emanated by heating the recording material by the heat-fixing means to the recording material after being subjected to the heat-fixing operation, wherein the recording material absorbs the water vapor applied thereto to correct its shape;

wherein said heat-fixing means includes a fixing roller containing therein a heating source, a pressing roller for pressing a toner image to be fixed to said fixing roller, a separating means for separating the recording material from said fixing roller, and a couple of discharging rollers, located spaced apart from said fixing and pressing rollers, which rotates at a higher peripheral speed than that of the fixing and pressing rollers to apply tension to the recording material between the couple of discharging rollers and the fixing and pressing rollers.

* * * * *

UNITED STATES PATENT AND TRADEMARK OFFICE

CERTIFICATE OF CORRECTION

PATENT NO. : 4,652,110 Sheet 1 of 5

DATED : March 24, 1987

INVENTOR(S) : YASUSHI SATO, ET AL.

It is certified that error appears in the above-identified patent and that said Letters Patent is hereby corrected as shown below:

COLUMN 1, line 9, "relates/to" should read --relates to--;

line 37, after "apparatus," insert --in--;

line 38, delete "a";

line 50, delete "to" (second occurrence.

COLUMN 2, line 10, "4,375.327" should read --4,375,327--;

line 20, after "to" (second occurrence) insert --the--;

line 22, delete "the" (first occurrence);

line 23, delete "the" (first occurrence);

line 38, amount of the curling" should read --the amount of curling--.

COLUMN 3, line 13, delete "a";

line 23, "portions" should read --portion--;

line 68, delete ",".

COLUMN 4, line 12, delete ",".

UNITED STATES PATENT AND TRADEMARK OFFICE

CERTIFICATE OF CORRECTION

PATENT NO. : 4,652,110 Sheet 2 of 5

DATED : March 24, 1987

INVENTOR(S) : YASUSHI SATO, ET AL.

It is certified that error appears in the above-identified patent and that said Letters Patent is hereby corrected as shown below:

COLUMN 6, line 23, "conacted" should read --contacted--;

line 50, after "toward" insert --the--;

line 52, "drumm" should read --drum--.

COLUMN 7, line 37, "dangles" should read --dangle--;

line 52, "bening" should read --bending--; same line, "sheet 1" should read --sheet 9--.

COLUMN 8, line 1, "large" should read --larger--;

line 13, "9:60°" should read --9: 60°--;

line 14, "80° - 110°" should read --80° - 110°--;

line 17, "9:30° should read --9: 30°--;

line 21, "9:20°" should read --9: 20°--;

line 62, "neightborhood" should read --neighborhood--.

COLUMN 9, line 28, after "FIG. 7" insert --,--;

line 29, "while" should read --during--;

line 30, "during" should read --while--;

line 67, delete "9" (second occurrence).

UNITED STATES PATENT AND TRADEMARK OFFICE

CERTIFICATE OF CORRECTION

PATENT NO. : 4,652,110 Sheet 3 of 5

DATED : March 24, 1987

INVENTOR(S) : YASUSHI SATO, ET AL.

It is certified that error appears in the above-identified patent and that said Letters Patent is hereby corrected as shown below:

COLUMN 10, line 33, "pasage" should read --passage--;

line 62, "embodiment" should read --embodiments--;

line 66, "19a" should read --179a--.

COLUMN 11, line 23, delete "the";

line 51, "174-1 174-5" should read --174-1 - 174-5--;

line 64, "planger" should read --plunger--; same line, "plangers" should read --plungers--.

COLUMN 12, line 3, "above described" should read --above-described--;

line 5, "cross flow" should read --cross-flow--;

line 16, delete "and";

line 24, "plate" should read --plates--;

line 37, "material, the" should read --material (the--;

line 53, "tranfer" should read --transfer--.

COLUMN 13, line 4, "FIG. 2" should read --FIG. 12--;

line 49, "resistance" should read --resistor--.

UNITED STATES PATENT AND TRADEMARK OFFICE

CERTIFICATE OF CORRECTION

PATENT NO. : 4,652,110 Sheet 4 of 5

DATED : March 24, 1987

INVENTOR(S) : YASUSHI SATO, ET AL.

It is certified that error appears in the above-identified patent and that said Letters Patent is hereby corrected as shown below:

COLUMN 14, line 8, "states" should read --state--;

line 29, after "171" insert --,--;

line 43, after "however" insert --,--;

line 67, "114A" should read --112A--.

COLUMN 15, line 65, "receive" should read --receives--;

line 68, delete "," (second occurrence).

COLUMN 16, line 1, "outut" should read --output--;

line 13, "tranfer" should read --transfer--;

line 23, "an" should read --and--;

lines 29-30, "incon- junction" should read --in conjunction--;

line 32, "171" should read --170b--;

line 62, "results" should read --result--.

COLUMN 18, line 23, "operation is" should read --operations are--.

COLUMN 19, line 13, "has" should read --having--.

UNITED STATES PATENT AND TRADEMARK OFFICE

CERTIFICATE OF CORRECTION

PATENT NO. : 4,652,110 Sheet 5 of 5

DATED : March 24, 1987

INVENTOR(S) : YASUSHI SATO, ET AL.

It is certified that error appears in the above-identified patent and that said Letters Patent is hereby corrected as shown below:

COLUMN 20, line 22, "mechanim" should read --mechanism--;

line 30, after "apparatus" insert --,--;

line 39, after "means" insert --,--;

COLUMN 21, line 5, delete "forming" (second occurrence).

Signed and Sealed this

Eleventh Day of August, 1987

*Attest:*

DONALD J. QUIGG

*Attesting Officer*

*Commissioner of Patents and Trademarks*